US008406943B2

(12) United States Patent
Brand et al.

(10) Patent No.: US 8,406,943 B2
(45) Date of Patent: Mar. 26, 2013

(54) APPARATUS AND METHOD FOR CONTROLLING REMOTE TRAIN OPERATION

(75) Inventors: John Brand, Melbourne, FL (US); Jared Klineman Cooper, Melbourne, FL (US); Gregory Hrebek, Palm Bay, FL (US); Brian McManus, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/567,128

(22) Filed: Aug. 6, 2012

(65) Prior Publication Data

US 2012/0292457 A1 Nov. 22, 2012

Related U.S. Application Data

(62) Division of application No. 12/344,846, filed on Dec. 29, 2008, now Pat. No. 8,280,567.

(51) Int. Cl.
*B61L 23/00* (2006.01)

(52) U.S. Cl. ..... 701/19; 345/629; 340/937; 246/293

(58) Field of Classification Search ..... 701/19, 701/20; 340/902, 937, 576; 246/167 R, 246/182 R, 122 R; 345/629
See application file for complete search history.

(56) References Cited

U.S. PATENT DOCUMENTS

| | | | | |
|---|---|---|---|---|
| 6,374,165 | B2 * | 4/2002 | Oguma et al. | 701/19 |
| 2004/0239688 | A1 * | 12/2004 | Krajec | 345/629 |
| 2007/0124332 | A1 * | 5/2007 | Ballesty et al. | 707/104.1 |

* cited by examiner

*Primary Examiner* — Mark Le
(74) *Attorney, Agent, or Firm* — GE Global Patent Operation; John A. Kramer

(57) ABSTRACT

A method of verifying clearance of a rail crossing includes: (a) detecting the presence of a train near the crossing, the train being equipped with a locomotive control unit; (b) in response to detection of the train near the crossing, generating a unique code; (c) capturing an image of the crossing; (d) transmitting the unique code along with the image to a remote operator control unit; (e) using the locomotive control unit, waiting for a response from the operator control unit containing the unique code; and (f) if the response containing the unique code is received by the locomotive control unit, permitting further operation of the train and, if the unique code is not received by the locomotive control unit, carrying out an automatic response which prevents movement of the train through the crossing.

15 Claims, 4 Drawing Sheets

APPARATUS AND METHOD FOR CONTROLLING REMOTE TRAIN OPERATION

This application is a divisional of, and claims priority to, U.S. patent application Ser. No. 12/344,846, filed Dec. 29, 2008, hereby incorporated, by reference.

BACKGROUND OF THE INVENTION

This invention relates generally to trains and other rail vehicles and more particularly to systems and methods for remote control of trains.

It is known to remotely control locomotive functions such as braking and throttle using a portable wireless device to transmit commands to a receiver on board the locomotive. One such system is commercially available under the trade name LOCOTROL RCL.

Remote control locomotive systems reduce the need for human operators on board locomotives and are frequently used in rail yards. However, rail yards typically include at least several unsecured crossings, which lack signals, crossing gates, and/or other safety mechanisms. Current Federal Railroad Administration (ERA) regulations require the locomotive operator to be physically present at such crossings. This forces the operator to move around with the locomotive being controlled, rather than staying in a fixed location, and in part defeats the benefits of using remote control.

Systems have been proposed which use cameras to provide video surveillance of unsecured, crossings, allowing an operator to monitor them remotely. However, these systems do not guarantee that the operator is paying attention to a particular crossing when the train he is controlling is actually passing through it.

BRIEF DESCRIPTION OF THE INVENTION

These and other shortcomings of the prior art are addressed by the present invention, embodiments of which provide a system and method for verification that a crossing is clear using video surveillance.

According to one aspect of the invention, a method of verifying clearance of a rail crossing includes: (a) detecting the presence of a train near the crossing, the train being equipped with a locomotive control unit; (b) in response to detection of the train near the crossing, generating a unique code; (c) capturing an image of the crossing; (d) transmitting the unique code along with the image to a remote operator control unit; (e) at the locomotive control unit, waiting for a response from the operator control unit containing the unique code; and (f) if the response containing the unique code is received by the locomotive control unit, permitting farther operation of the train and if the unique code is not received by the locomotive control unit, carrying out an automatic response which prevents movement of the train through the crossing. The term "train" refers to one or more interconnected rail vehicles configured to travel along a track, where at least one of the rail vehicles is a locomotive or other powered unit.

According to another aspect of the invention, an apparatus is provided for verifying clearance of a rail crossing, including a clearance system which has: (a) a camera; (b) a video combiner operatively coupled to the camera; and (c) a wireless transmitter operatively coupled to the camera and the video combiner. The clearance system is programmed to: (i) detect the presence of a train near the crossing; (ii) combine one or more images of the crossing captured by the camera with a unique code to create a combined image; and (iii) transmit the combined image to a remote display.

According to another aspect of the invention, a method of controlling operation of a train includes: (a) generating a unique code using a locomotive control unit carried on-board the train; (b) capturing an image of track ahead of the train; (c) transmitting the unique code along with the image to a remote operator control unit; (d) at the locomotive control unit, waiting for a response from the operator control unit containing the unique code; and (e) if the response containing the unique code is received by the locomotive control unit, permitting further operation of the train and, if the unique code is not received by the locomotive control unit, carrying out an automatic response which restricts movement of the train.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
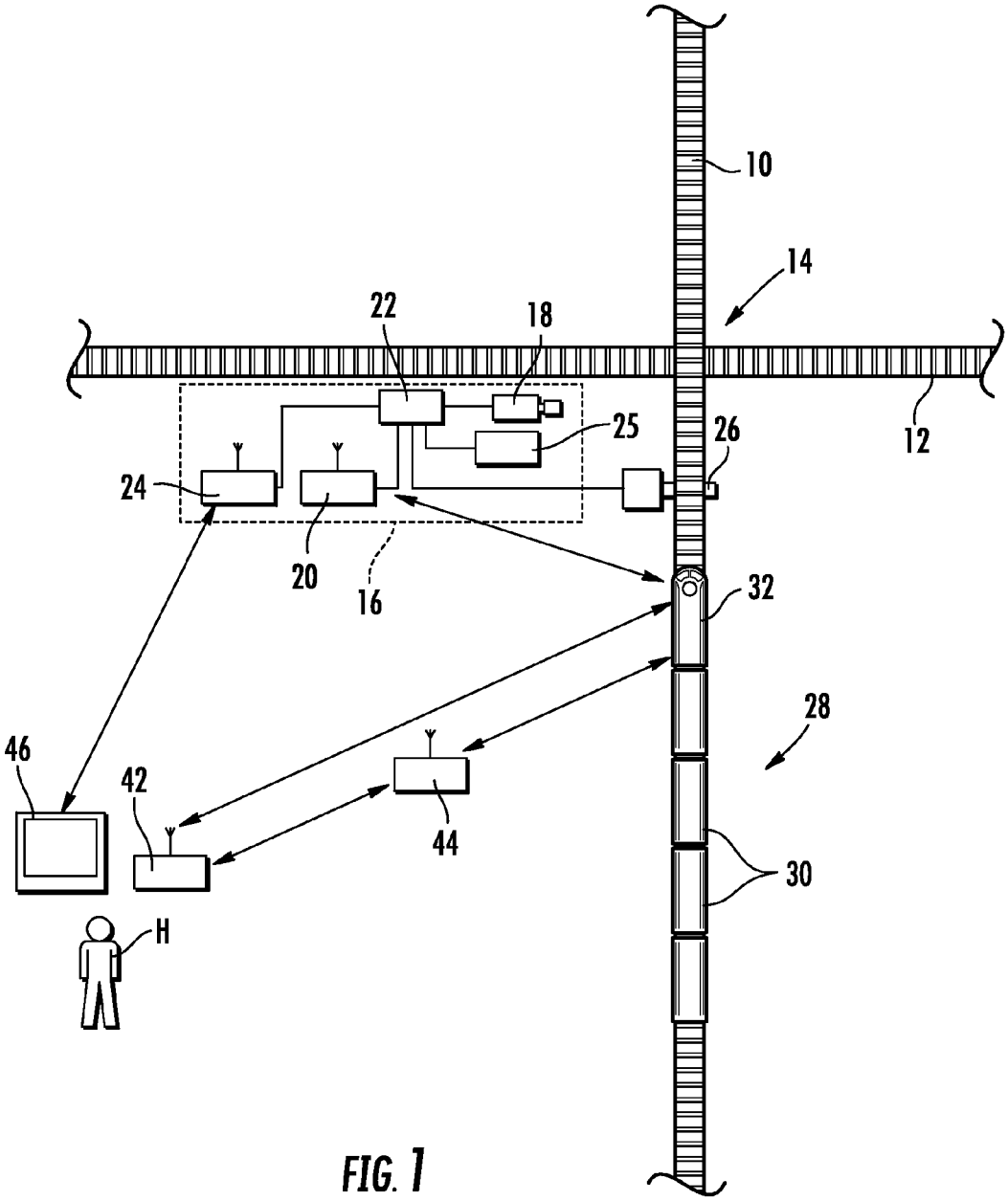
FIG. 1 is a schematic plan view of a rail system constructed according to an aspect of the present invention.

Referring to the drawings wherein identical reference numerals denote the same elements throughout the various views, FIG. 1 shows an overhead plan view of a rail system that includes a first track 10 intersecting a second track (or vehicle roadway) 12 at a crossing 14. Such track configurations might be found, for example, in a rail yard where rail cars are decoupled, positioned, and recoupled in various combinations to make up trains, which are then directed to various tracks.

A crossing clearance system 16 is located near the crossing 14. In the illustrated example the clearance system 16 comprises a camera 18, a data receiver 20, a video combiner 22, and a video transmitter 24. The clearance system 16 may also include a processor 25 for generating unique codes, as described in more detail below. The camera 18 may be a still or video camera, and may be analog or digital. The camera 18 is mounted and positioned so as to have an adequate field of view of the crossing 14, such that one or more images from the camera 18 can be used to determine whether or not the crossing 14 is occupied. The components of the clearance system 16 are operatively connected such that images from the camera 18 and information from the data receiver 20, or the processor 25, can be combined and then transmitted for use in verifying crossing clearance, as described in more detail below.

It is noted that, in the figures, the lines shown connecting individual devices or components represent their logical or functional interconnections and need not be physical connections. For example, in some implementations these connections may take the form of messages on a data network, or wireless communications channels.

The crossing 14 incorporates a train sensor 26 to determine when a train is nearby. Examples of known types of train sensors 26 include wheel weight sensors and radio-frequency (RF)-based trackside detectors, which interrogate and detect automatic equipment identification (AEI) tags carried by a train. The train sensor 26 is coupled to the clearance system 16.

Figure 2:
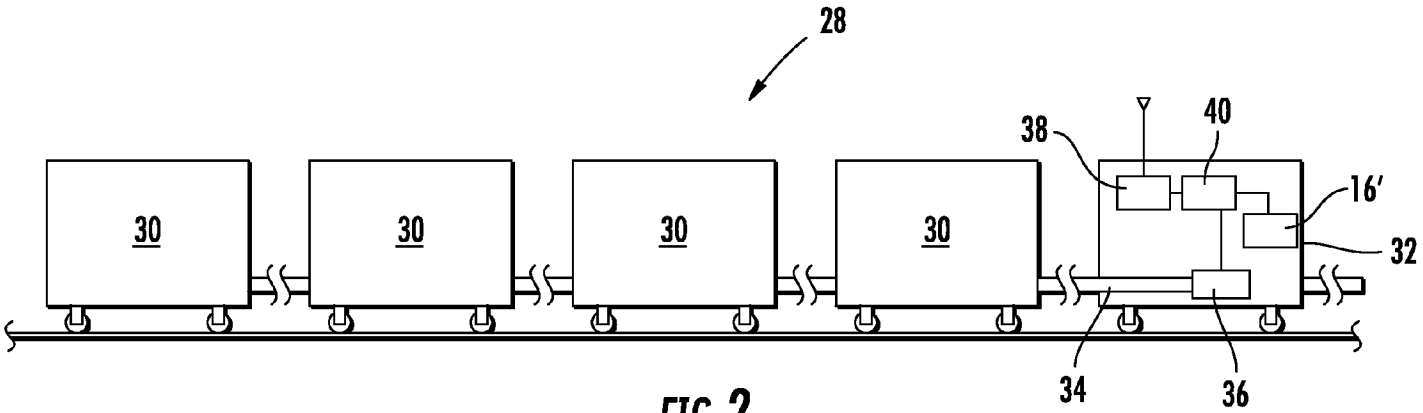
FIG. 2 is a schematic side view of a train shown in FIG. 1.

A train 28 is shown approaching the crossing 14. The train 10 includes a plurality of coupled cars 30, and a locomotive 32 or other powered unit that provides tractive force. Multiple locomotives 32 may be used. As shown in FIG. 2, the individual cars 30 are coupled together by a brake pipe 34 that conveys air pressure changes specified by an air brake controller 36 in the locomotive 32. As used herein, the term "air brake controller" refers generally to one or more components which cooperate to selectively hold or release pressure from the brake pipe 34 and which may include mechanical valves, electrical or electronic controls associated with those valves, or combinations thereof. Each of the cars 30 is provided with a known type of air brake system which functions to apply air brakes on the car 30 upon a pressure drop in the brake pipe 34 and to release the air brakes upon a pressure rise.

The locomotive 32 is equipped with a wireless transceiver 38 which functions to receive and transmit radio frequency (RF) communications over a wireless communications channel. The specific frequency band and data format of the communications channel is not critical. The transceiver 38 is coupled to a locomotive control unit ("LCU") 40, which is in turn coupled to the air brake controller 36 as well as to the locomotives throttle and reversing controls. The LCU 40 may also be coupled to auxiliary controls such as the locomotive lights, bell, or horn.

Figure 3:
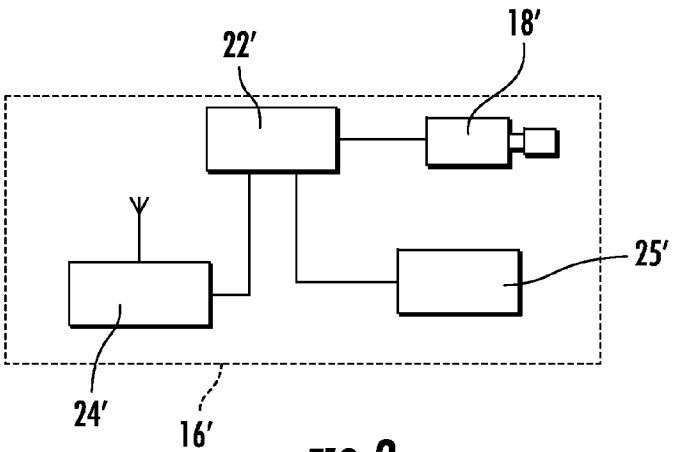
FIG. 3 is a schematic view of a clearance system carried on-board the train of FIG. 2.

Optionally, a crossing clearance system 16' may be carried on board the locomotive 32. As shown in FIG. 3, the crossing clearance system 16' includes a camera 18', video combiner 22', video transmitter 24', and processor 25' corresponding to the same components in the wayside crossing clearance system 16 described above. The camera 18' is mounted in the locomotive 32 so as to have a clear field of view of the track ahead of the locomotive 32. The crossing clearance system 16' is operatively coupled to the LCU 40 and does not require a separate data receiver as used in the wayside clearance system 16.

Referring again to FIG. 1, a human operator "H" external to the locomotive 32 is provided with an operator control unit ("OCU") 42, which, along with the LCU 40, is part of a remote control system. An example of a suitable remote control system is commercially known as LOCOTROL RCL. The OCU 42 is effective to transmit coded commands for various locomotive operations to the transceiver 38 in the locomotive 32. Examples of operations include forward-neutral-reverse selection, train and/or independent brake applications, operating the locomotives bell or horn, and so forth.

RF communications between the locomotive 32 and the OCU 42 may be accomplished using one or more off-board repeaters or routers 44 disposed within radio communication distance of the train 10 and the OCU 42 for relaying communications transmitted between the OCU and the locomotive 32. The repeater or router 44 includes a transceiver that operates to relay (e.g., receive and retransmit) messages. Such devices are frequently used at locations with heavy rail traffic, such as rail yards, to assist with relaying communications. Communications between the OCU 42 and the locomotive may thus occur over a network or as direct point-to-point RF transmissions.

Figure 4:
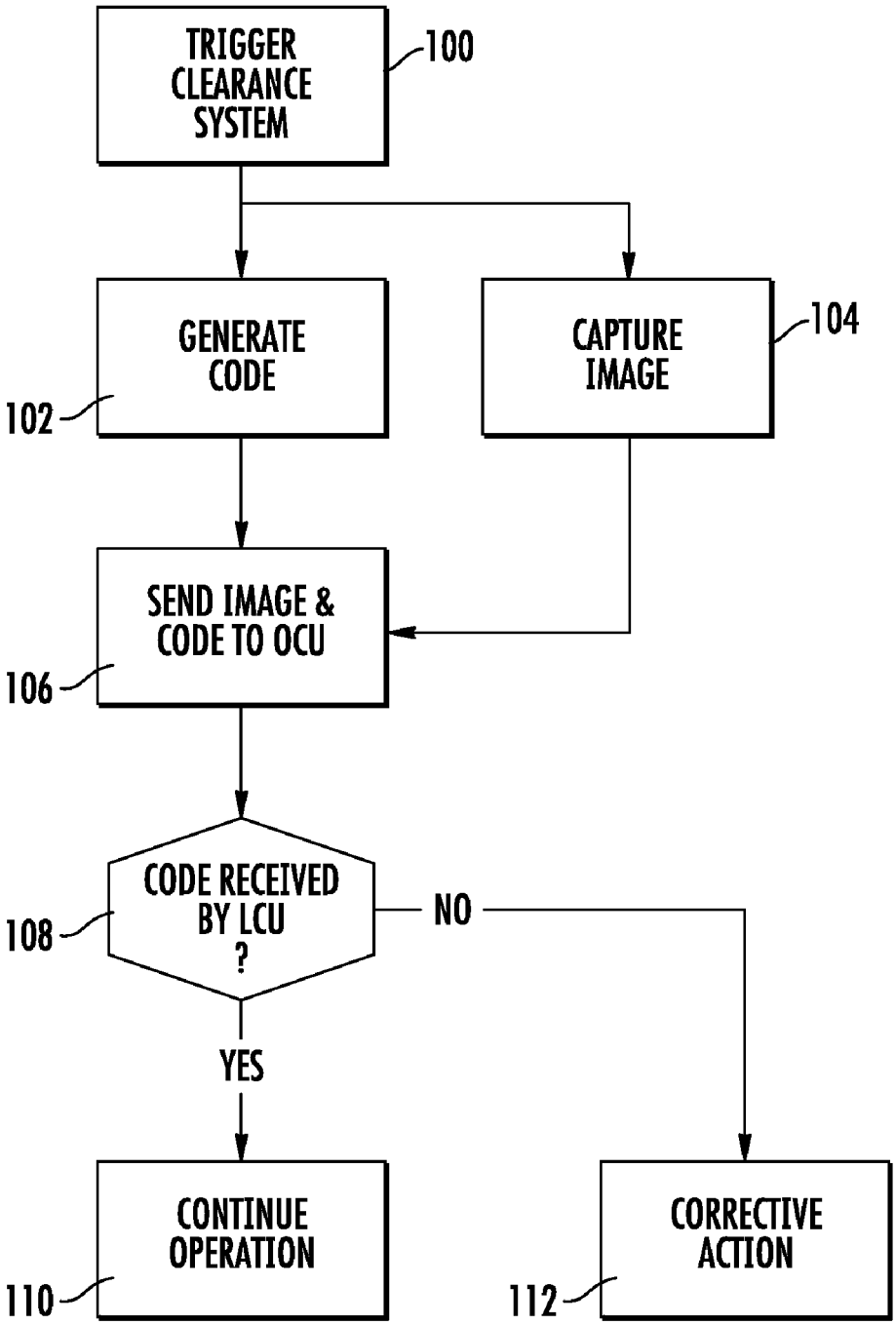
FIG. 4 is a block diagram illustrating the operation of a crossing clearance system according to an aspect of the present invention.

FIG. 4 is a block diagram of the process for verifying clearance of a rail crossing 14, e.g., as carried out by the crossing clearance system 16, OCU 42, and LCU 40. Beginning at block 100, the crossing clearance system 16 is triggered when a train approaches the crossing 14, e.g., by the train sensor 26.

Once the clearance system 16 is triggered, the clearance system 16 transmits an interrogation signal. For example, the interrogation signal may be transmitted to the LCU 40 on the train 28. In response, the train 28 generates a unique code (block 102). Software within the LCU 40 could be used to generate a random number as the basis for the unique code. Alternatively, the processor 25 of the clearance system 16 could generate the unique code and transmit it to the LCU 40. As discussed in more detail below, the unique code is designated for display to the operator H, for the operator H to enter the displayed code into the OCU 42 for purposes of confirming that the operator is paying attention to information (e.g., video or other images) provided about the train approaching the crossing. As such, for convenience purposes, the unique code may be translated from the random number into a single command or a sequence of commands that can be easily entered into the OCU 42 using the existing keys or switches of the OCU 42. For example, a sequence might be "BUTTON1-BUTTON2-FWD-REV-BELL". Optionally, the unique code could simply be a random number or other sequence of characters or symbols not related to regular operating commands of OCU 42. In such a case the OCU 42 would be provided with additional keys or switches to allow entry of the unique code.

Figure 5:
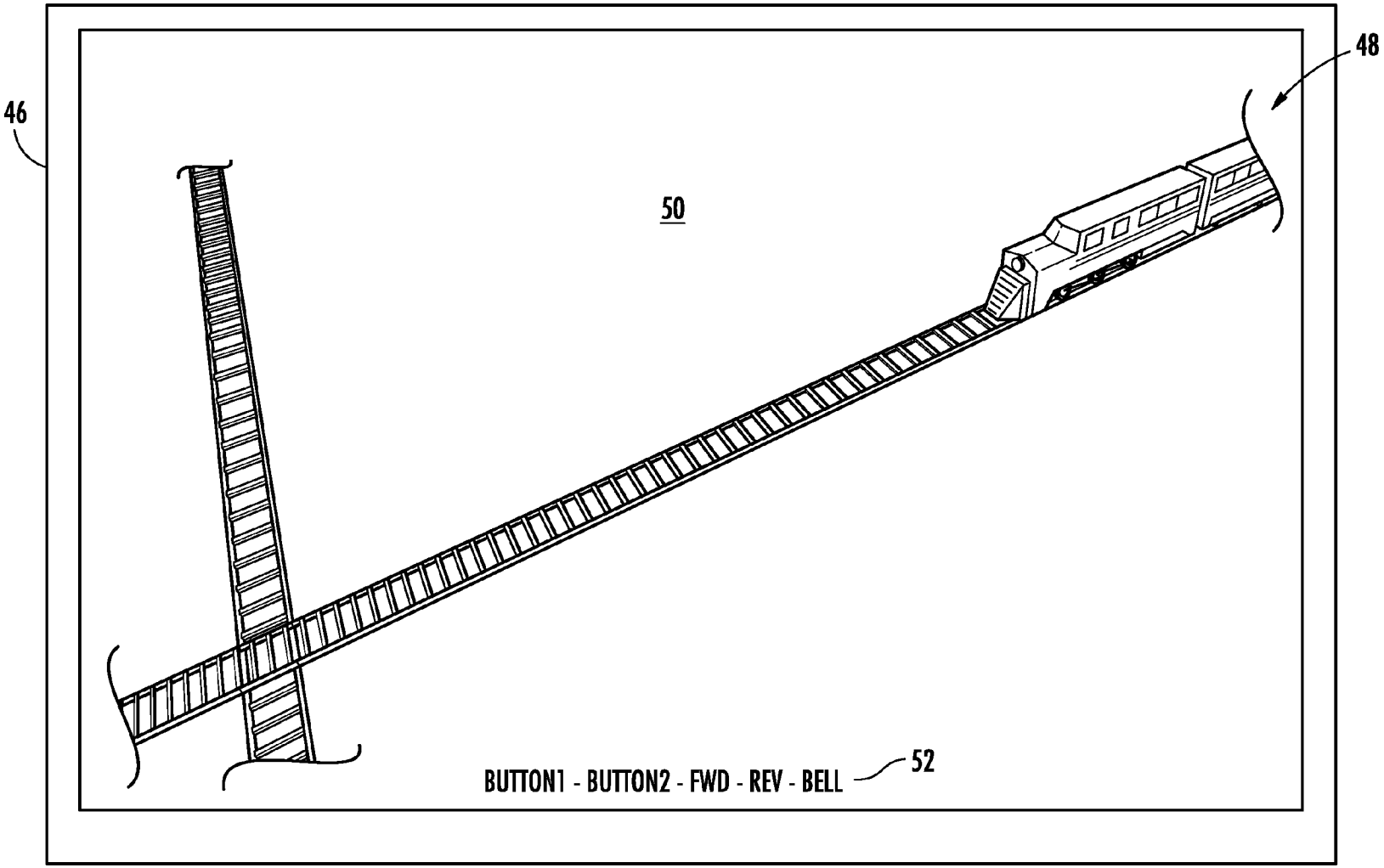
FIG. 5 is a schematic illustration of a display constructed according to an aspect of the present invention.

Simultaneously, the camera 18 captures an image of the crossing 14 (block 104). The image could be continuous video, a short segment of video, or a series of still images. The video combiner 22 combines the image with a visual representation of the unique code. Any visual format which is recognizable by a human operator H may be used to represent the unique code, such as text, colors, pictographs or icons of control switches to be operated, and the like. At block 106, the video transmitter 21 transmits the combined image to a display 46, which is located, near the human operator H (see FIG. 1). The display 46 may be part of the OCU 42, or it may be separate from the OCU 42. FIG. 5 shows an example of a combined image 48 that includes the image 50 of the crossing 14, overlaid with a band 52 (e.g., text window) containing a textual representation of the unique code formatted as a sequence of commands. The image 50 and the unique code need not be physically combined so long as they are displayed in a manner such that the human operator H must be paying attention to the image 50 in order to receive (view and read) the unique code.

When the human operator H observes the image, he can ascertain whether or not the crossing is clear for the train 28 to enter. At the same time, he will read the unique code and then enter the code into the OCU 42. The OCU 42 then transmits the entered code to the LCU 40 as part of a response message/signal.

At block 108, the LCU 40 waits to receive the unique code from the OCU 42. A predetermined timeout period is provided, for example about 30 to 60 seconds after the clearance system 16 is triggered. If the unique code is received within the timeout period, continued operation of the train 28 is permitted (block 110). If the unique code is not received within the timeout period, an automatic pre-programmed response is taken by the LCU 40, such as a speed (e.g., throttle notch) reduction or a penalty brake application (block 112). The timeout period may be dynamic in order to guarantee that a predetermined time and distance is available to either confirm crossing clearance, or to slow or stop the train 28. For example, the greater the train's speed and the closer it is to the crossing 14, the shorter the timeout period would be. (As should be appreciated, therefore, "predetermined" timeout period refers to both a set/static timeout period and a dynamic timeout period determined according to designated criteria.) The cycle then returns to block 102 and repeats at intervals until the train 28 passes through the crossing 14. If the on-board clearance system 16' is used, its operation is similar to that of the wayside clearance system 16, the main difference being that the image is transmitted from the locomotive 32 to the display 46. If the on-board clearance system 16' is used, it may be triggered, for example by a wayside beacon, so as to be active only neuro crossing 14. Alternatively, it could be used any time the locomotive 32 is in operation, completing the code generation and response cycle at intervals.

Steps may be taken to discriminate the unique code from regular operational commands. For example, the LCU 40 may be programmed to ignore all commands not corresponding to the unique code during the timeout period. Alternatively, the unique code may have sequence or timing characteristics unlikely to coincide with regular operational commands. For example, the unique code may include several reverser (direction change) commands separated by a very short interval, or it may include a throttle notch increase command immediately followed by a reverser command.

The use of a unique code guarantees that the response required to allow the train 28 to enter the crossing 14 cannot be memorized or predicted, but can only be acquired by the human operator H paying attention to the real-time status of the crossing 14. This feature extends the potential use of remote control locomotives while also mitigating any potential drawbacks and enhancing safety.

The crossing clearance system 16 may be used in a location, such as a rail yard, where multiple trains 28 are being operated under remote control. Therefore, optionally, the crossing clearance system 16 may incorporate means for notifying a particular human operator H that his train 28 has triggered the crossing clearance system 16. For example, if the clearance system 16 is triggered by an AEI tag, the AEI tag response will contain information uniquely identifying the train 28. In response, the clearance system 16 may either send an alert signal with the train identification to all OCUs 42 or, in a networked configuration, the clearance system 16 may send an alert signal to a particular OCU 42. The alert signal could take the form a text or graphical message, a light or icon, or a sound alert. In any case, the alert signal informs the operator H that he needs to observe the display 46.

As noted above, embodiments of the present invention are applicable not only to verifying the clearance of rail crossings, but also to verifying track conditions in front of a train generally. Thus, one embodiment relates to a method of controlling operation of a train, which comprises generating a unique code using, e.g., a locomotive control unit carried on-board the train. (In one embodiment, "unique" refers to a code generated for purposes of operator crossing image verification, as described herein, which is separate and different from other codes used in the remote control and/or rail system. Typically, a different code is generated each time crossing image verification is carried out; however, this does not preclude code repetition, as long as an operator H has a minimal chance of guessing the code.) The method additionally comprises capturing an image of track ahead of the train, and then transmitting the unique code along with the image to a remote operator control unit. The code and image are displayed on the operator control unit to an operator H, thereby prompting the operator to enter the code into the operator control unit. Any input entered into the operator control unit is transmitted as a response to the locomotive control unit. The locomotive control unit waits for a response from the operator control unit containing the unique code. If a response containing the unique code is received by the locomotive control unit, further operation of the train is permitted. However, if the unique code is not received by the locomotive control unit (within a predetermined timeout period or otherwise), an automatic response is carried out that restricts movement of the train, such as automatically applying a braking function of the train to bring the train to a stop.

As should be appreciated, the operator control unit 42 may be further configured to display additional information to the operator H. For example, the length of the timeout period may be displayed to the operator H as a countdown function, to ensure that the operator is aware of how much time is available to enter the code before an automatic response is carried out. Additionally, text/code editing functionality may be provided to enable the operator to modify any entered input prior to transmission to the LCU 40. For example, after the code 52 is displayed, subsequent operator input into the OCU 42 may also be displayed to show the operator what he has entered, and allowing the operator to delete any incorrect entries prior to transmission. Another option is for automatic transmission of whatever the operator has entered at or just prior to the end of the timeout period.

The foregoing has described a crossing clearance system and a method for its operation. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

The invention claimed is:

1. A method of verifying clearance of a rail crossing, comprising:

(a) detecting the presence of a rail vehicle near the crossing, the rail vehicle being equipped with a rail vehicle control unit;

(b) in response to detection of the rail vehicle near the crossing, generating a unique code;

(c) capturing an image of the crossing;

(d) transmitting the unique code along with the image to a remote operator control unit;

(e) at the rail vehicle control unit, waiting for a response from the operator control unit containing the unique code; and (f) if the response containing the unique code is received by the rail vehicle control unit, permitting farther operation of the rail vehicle and, if the unique code is not received by the rail vehicle control unit, carrying out an automatic response which prevents movement of the rail vehicle through the crossing.

2. The method of claim 1, further comprising repeating steps (a)-(f) until the rail vehicle has passed through the crossing.

3. The method of claim 1 wherein the unique code is combined with the image.

4. The method of claim 1, wherein the unique code is generated by the rail vehicle control unit.

5. The method of claim 1, wherein the image is transmitted wirelessly from a camera disposed near the crossing to the operator control unit.

6. The method of claim 1, wherein the unique code is formatted as a sequence of commands of the remote operator control unit for movement of the rail vehicle.

7. The method of claim 1, further including sending an alert signal to the operator control unit when the image is transmitted, the alert signal uniquely identifying the rail vehicle.

8. The method of claim 1, wherein the automatic response is braking the rail vehicle to a stop.

9. The method of claim 1, wherein the rail vehicle control unit carries out the automatic response unless the unique code is received within a predetermined timeout period after the unique code is transmitted to the operator control unit.

10. The method of claim 9, wherein the timeout period, is dynamically variable depending on at least one of a speed of the rail vehicle and a distance from the rail vehicle to the crossing.

11. The method of claim 1, wherein the operator control unit is disposed at a location external to the rail vehicle.

12. A method of controlling operation of a rail vehicle, comprising:

(a) generating a unique code using a rail vehicle control unit carried on-board the rail vehicle;

(b) capturing an image of track ahead of the rail vehicle;

(c) transmitting the unique code along with the image to a remote operator control unit;

(d) at the rail vehicle control unit, waiting for a response from the operator control unit containing the unique code; and (e) if the response containing the unique code is received by the rail vehicle control unit, permitting further operation of the rail vehicle and, if the unique code is not received by the rail vehicle control unit, carrying out an automatic response which restricts movement of the rail vehicle.

13. The method of claim 12, farther comprising repeating steps (a)-(e) at intervals so long as the rail vehicle is moving.

14. The method of claim 12, wherein the automatic response is braking the rail vehicle to a stop.

15. A method of verifying clearance of a rail crossing, comprising:

detecting the presence of a rail vehicle approaching the rail crossing, the rail vehicle being equipped with a rail vehicle control unit;

in response to detection of the rail vehicle approaching the rail crossing, generating a unique code;

capturing an image of the crossing;

transmitting the unique code along with the image to a remote operator control unit; and if a response containing the unique code is received by the rail vehicle control unit from the operator control unit within a predetermined timeout period, permitting further operation of the rail vehicle and, if the response containing the unique code is not received by the rail vehicle control unit within the predetermined timeout period, carrying out an automatic response which prevents movement of the rail vehicle through the crossing.

* * * * *

UNITED STATES PATENT AND TRADEMARK OFFICE

CERTIFICATE OF CORRECTION

PATENT NO. : 8,406,943 B2
APPLICATION NO. : 13/567128
DATED : March 26, 2013
INVENTOR(S) : Brand et al.

It is certified that error appears in the above-identified patent and that said Letters Patent is hereby corrected as shown below:

In the Specification:

In Column 1, Line 7, delete "incorporated," and insert -- incorporated --, therefor.

In Column 1, Line 24, delete "(ERA)" and insert -- (FRA) --, therefor.

In Column 1, Line 30, delete "unsecured," and insert -- unsecured --, therefor.

In Column 1, Line 52, delete "farther" and insert -- further --, therefor.

In Column 1, Line 53, delete "and" and insert -- and, --, therefor.

In Column 3, Line 6, delete "10" and insert -- 28 --, therefor.

In Column 3, Line 28, delete "locomotives" and insert -- locomotive's --, therefor.

In Column 3, Line 52, delete "locomotives" and insert -- locomotive's --, therefor.

In Column 3, Line 56, delete "10" and insert -- 28 --, therefor.

In Column 4, Line 36, delete "21" and insert -- 24 --, therefor.

In Column 4, Line 37, delete "located," and insert -- located --, therefor.

In Column 5, Line 11, delete "neuro" and insert -- near a --, therefor.

In the Claims:

In Column 6, Line 50, in Claim 1, delete "farther" and insert -- further --, therefor.

Signed and Sealed this
Thirtieth Day of July, 2013

Teresa Stanek Rea

Teresa Stanek Rea
*Acting Director of the United States Patent and Trademark Office*

In Column 7, Line 10, in Claim 10, delete “period,” and insert -- period --, therefor.

In Column 8, Line 5, in Claim 13, delete “farther” and insert -- further --, therefor.